United States Patent [19]

Wilde et al.

[11] 4,089,083

[45] May 16, 1978

[54] DOOR ARRESTORS

[76] Inventors: Melvyn Wilde, 21 Lime Grove, Lowton, Warrington; Robert John Sutton, 50 Westbourne Rd., Southport, both of England

[21] Appl. No.: 783,566

[22] Filed: Apr. 1, 1977

[30] Foreign Application Priority Data

Aug. 24, 1976 United Kingdom ..... 35110/76
Sep. 23, 1976 United Kingdom ..... 39452/76

[51] Int. Cl.[2] ..... E05F 5/02
[52] U.S. Cl. ..... 16/82
[58] Field of Search ..... 16/49, 82, 85, 86 B; 109/63.5; 292/341.2

[56] References Cited

U.S. PATENT DOCUMENTS

| | | | |
|---|---|---|---|
| 615,034 | 11/1898 | Merrill | 16/85 |
| 1,394,420 | 10/1921 | Lawrence | 16/85 |
| 1,561,726 | 11/1925 | Kerr | 16/85 |
| 1,858,886 | 5/1932 | DeGuenther | 16/85 |
| 2,869,171 | 1/1959 | Levine | 16/83 |

*Primary Examiner*—Ronald Feldbaum
*Attorney, Agent, or Firm*—Larson, Taylor and Hinds

[57] ABSTRACT

A door arrestor which can be fitted to the lintel of a door frame. The arrestor has a body part which is secured to the lintel and a plunger part which projects from the body part and can move into the body part when struck by the closing door. For a door shutting rapidly the plunger is arrested after completing only a part of its movement and hence the door is arrested before it closes. For a door shutting slowly the plunger is free to complete its whole movement and hence the door is allowed to close. The plunger moves against the action of a spring so that when the door is re-opened the plunger projects again from the body part. The plunger carries a headless loose pin movable in a slot in the plunger and in slots in the body part. With a rapid shutting door the pin is trapped before it completes a full movement and this trapping arrests the plunger. With a slow shutting door the pin has time to fall under gravity to escape being trapped and hence is freed to complete a full movement in its slots.

6 Claims, 6 Drawing Figures

DOOR ARRESTORS

BACKGROUND OF THE INVENTION

This invention relates to door arrestors.

One well known form of door arrestor comprises a damper arrangement with a pair of hinged arms, with one part of the arrestor attached to the door frame and the other part attached to a door. It is rather costly, rather bulky, fairly complex in operation and requires careful fitting, and whilst, on the one hand it is used extensively in industrial and commercial premises it does not find common domestic use. On the other hand there is a need for a simple, relatively inexpensive door arrestor which can be easily fitted.

SUMMARY OF THE INVENTION

It is accordingly a main object of the present invention to provide a door arrestor which is capable of being manufactured in simple, and inexpensive but durable materials such as synthetic plastics materials so that it might be sold at a low price so as to encourage fitting on all doors in a building as standard equipment but especially on glazed doors and doors that can be used and touched by children.

It is also an object of the present invention to provide a door arrestor which can be attached to one member only of a door/door frame combination to provide the arrest of the door before it closes completely when, just prior to closing, the door is moving above a threshold velocity but allows the door to close when moving below said threshold.

The objects are achieved in a door arrestor comprising a body part for mounting on a door frame, the body part having a roof and side walls defining first slot means; a plunger part projecting from the body part, movable in to and out from the body part and defining second slot means; spring means between the body part and the plunger part acting in a sense to cause the plunger part to project from the body part; headless pin means loosely carried in and extending through both said first and second slot means; said first slot means comprising an upper forward cavity in which the pin means is located when the plunger part is fully projecting from the body part, a rearwardly extending downward incline from said cavity down which the pin means can move as the plunger part moves into the body part, and a travelway at the base of the incline extending towards the rearward lower regions of said side walls; and said second slot means comprising, rearward in the plunger, a vertical fall cavity for the pin means; and one of said slot means comprising a buttress wall against which the pin means can strike to arrest the plunger part when the plunger part moves into the body part above a threshold velocity and which the pin means can pass to permit the plunger part to complete its full movement into the body part when the plunger part moves into the body part below said threshold velocity.

DESCRIPTION OF THE PREFERRED EMBODIMENTS

Figure 1:
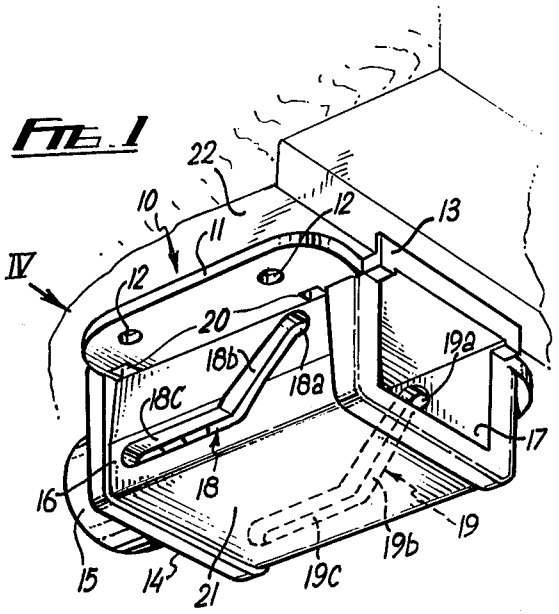
FIG. 1 shows in perspective the body, or lintel mounting, part of an arrestor according to the invention.
Figure 3:
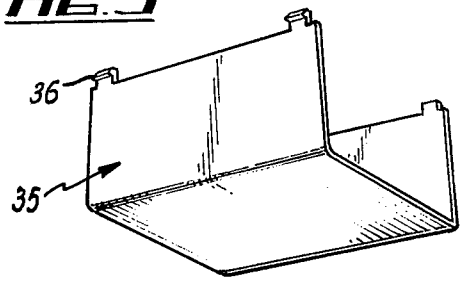
FIG. 3 shows, in perspective and exploded from the body and movable part, a cover of the arrestor.

In FIG. 1 there is shown an arrestor body part 10 having a roof 11 with mounting holes 12 and a lip 13. Extending from the roof 11 there is a rear wall 14, with a cylindrical cavity forming part 15, and two parallel side walls 16, 17 with first slot means in the form of slot-like openings 18, 19. Openings 20 in the roof 11 are provided to receive and engage fixing stems 36 of an arrestor cover (FIG. 3). The body part 10 has a floor 21. The openings 18, 19 have pin rest cavities **18*a*, 19*a* in the forward upper regions of the side walls; rearwardly extending downward inclines 18*a*, 19*b*; and horizontal travelways 18*c*, 19*c*, at the base of the inclines, extending towards the rearward lower regions of the side walls. The body part 10 is shown against the lintel 22 of a door frame to which it is secured by screws (not shown) through the holes 12. The lip 13** serves to position the body part on the lintel.

Figure 2:
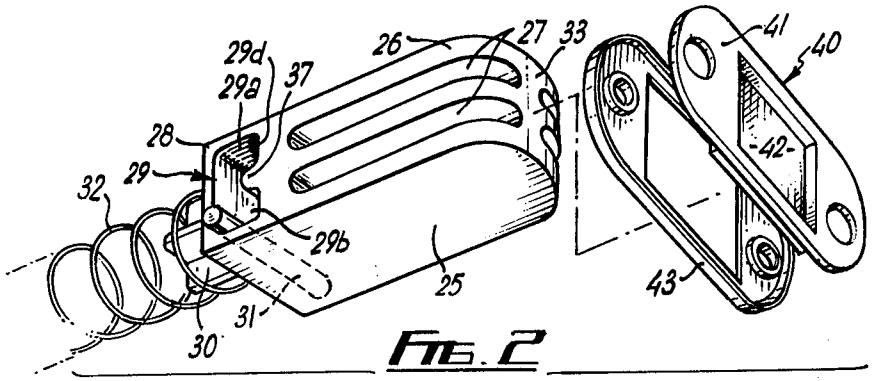
FIG. 2 shows in perspective and exploded from the body part a plunger part of the arrestor and separate door mounting parts.

In FIG. 2 there is shown an arrestor plunger part 25. This is a moulding having a forward part 26 with a rounded nose 33. The part 26 has recesses 27. The moulding has a rearward part 28 devoid of recesses but including a through passage or second slot means 29 and a cruciform-shaped spring retaining boss 30. Freely located in the passage 29 there is an arrestor pin means in the form of a steel pin 31 which extends beyond the walls of part 28. A spring 32 is carried on the boss 30. This spring also engages in the cavity 15. It will be seen from FIG. 4 that slot 29 has a vertical extent corresponding to the vertical extent of the slots 18, 19 as indicated by the arrow VE. The horizontal extent of slot 29 is not constant at all planes as there is provided a boss 37 extending into the slot 29 which the pin 31 can contact, under certain conditions of operation, once the pin has left the rest cavities **18*a*, 19*a* where it normally lodges. The boss partially divides the slot 29 into an upper compartment 29*a* and lower compartment 29*b*. The upper compartment has a buttress wall 29*d*.**

In FIG. 3 there is shown a cover 35 with fixing stems 36 to engage the openings 20 in the roof 11 of the body part 10. It will be seen from FIG. 4 that the nose 33 projects beyond the casing when the arrestor is assembled and ready for use.

Figure 4:
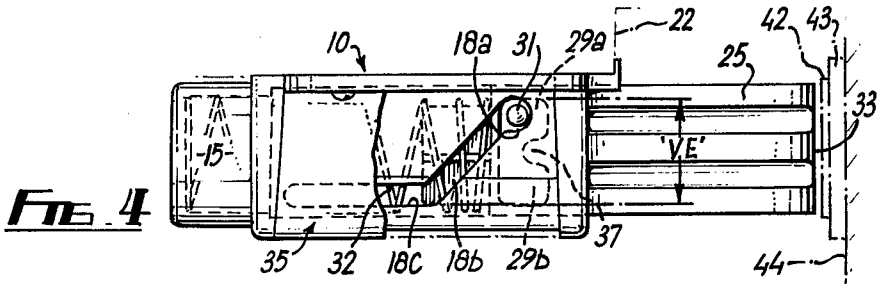
FIG. 4 shows the assembled arrestor in the direction of arrow IV just prior to being struck by a door.

In the assembled condition the arrestor, the rearward part of the plunger part 25 lies between the walls 16, 17, the roof 11 and floor 21 of the body part 10 with the pin 31 located as shown in FIG. 4, the spring 32 is lightly compressed between part 28 and the end wall of the cavity 15. The cover covers the walls, 16, 17 and in doing so prevents the pin 31 from becoming dislodged axially from the slots 18, 19. The cover is retained in position with the stems 36 engaged in the openings 20.

To install the arrestor, the arrestor is screwed at roof 10 to the lintel 22 with the lip 13 engaging that edge of the lintel recess which faces the door 44. With the door open the nose 33 projects beyond said edge and towards the door. With the door closed the nose 33 is in contact with the door and is approximately in line with the lip 13: the spring 32 is compressed and the pin 31 is engaged at the rearward regions of parts 18c and 19c of the slots 18, 19.

The plunger part 25, which is struck whenever the door closes, could be made of a strong but relatively soft plastics material (such as polyurethane) so that it possesses an energy absorbing characteristic and tends to keep the arrestor quiet in operation. The body part 10 is then made of a strong but relatively hard plastics material (such as "Nylon"). However, the arrestor above described is made from acetal copolymer with stainless steel spring and pin. The door 44 is preferably equipped with a soft polyurethane plastics impact pad 40 comprising a flange part 41 and a recessed part 42 held to the door by a rigid frame part 43.

In operation, with a door slamming, the nose 33 is impacted by the part 42 of pad 40 and the plunger part 25 of the arrestor commences to move rapidly at a velocity above a threshold velocity. At the initial part of this movement the pin remains in the cavities **18*a*, 19*a* but thereafter the forward end face of upper part 29*a* of slot 29 strikes the pin 31 and moves it from the cavities. On movement from the cavities the pin 31 alights on the nose of the boss 37 and before it can fall away from this nose it contacts the upper edge of the inclines 18*b*, 19*b* and is forced back against said forward end face of the upper part 29*a* of slot 29 and becomes trapped by "3-point" contact on said end face; on the top surface of boss 37; and the upper edges of inclines 18*b*, 19*b*. This prevents further movement of the plunger part 25 into the body part 10** and the door is arrested before it closes.

In operation, with a door closing more slowly, the nose 33 is contacted by the part 42 of pad 40 and the plunger part 25 commences to move at a velocity below said predetermined threshold velocity. For the initial part of the movement of plunger part 25, arrestor components move as above described for door slamming but at lower velocity. From the point where the pin 31 alights on the nose of the boss 37, the pin, with the lower velocities, is now able to fall away from the boss 37 and follow a downward path dictated by the inclines **18*b*, 19*b* and the surfaces of the slot 29. No impediment exist to the plunger part 25 now moving fully into the body part 10 with the pin completing passage down the inclines 18*b*, 19*b* and then along the travelways 18*c*, 19*c*** and this allows the door to close.

Figure 5:
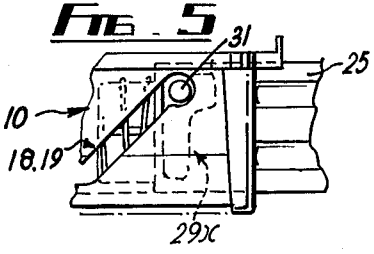
FIG. 5 shows a modified slot means.

In FIG. 5 the slope of the slot means **29*x* at the rearward end of the plunger part 25 has an inverted L-shape. The operation is as above described with reference to FIGS. 1 to 4**.

Figure 6:
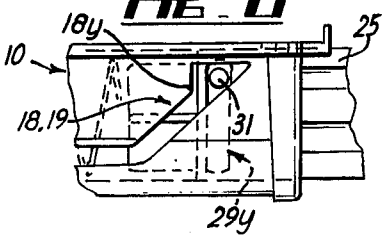
FIG. 6 shows a further modified slot means.

In FIG. 6 the shape of the slot means **29*y* at the rearward end of the plunger part 25 is that of a simple vertical slot. However the shape of the slot means in the body part is modified to introduce a vertical buttress wall 18*y* and this wall is impacted by the pin 31 when the plunger part 25 moves rapidly to prevent the part 25** moving fully into the body part.

The arrestor is typically secured to a door frame lintel at a distance from the door hinges of about one-third the lintel length.

The velocity threshold of the arrestor can be preset by suitable selection of the projection of the boss 37 into the slot 29. In general, and with one object of the invention to provide a low-priced arrestor, no provision is made for external threshold adjustment of the arrestor although this could be done such as, for example by providing a set screw in the body part of FIG. 6 to set the position of the wall 50.

The selection of the point of arrest in the movement of a closing door is governed by the positioning of the arrestor on the door frame. It would be possible to provide an adjustor on the nose 33 to select or modify the point of arrest.

Whilst the arrestor of FIG. 6 prevents a door slamming completely shut it will, after the door arrest has been made, allow the door to complete its closing movement.

Arrestors according to the invention could be used with hinged, sliding or pivot doors and with other moving framed and panel structures such as windows.

What we claim is:

1. A door arrestor comprising a body part for mounting on a door frame, the body part having a roof and side walls defining first slot means; a plunger part projecting from the body part, movable in to and out from the body part and defining second slot means; spring means between the body part and the plunger part acting in a sense to cause the plunger part to project from the body part; headless pin means loosely carried in and extending through both said first and second slot means; said first slot means comprising an upper forward cavity in which cavity the pin means is located when the plunger part is fully projecting from the body part, a rearwardly extending downward incline from said cavity down which the pin means can move as the plunger part moves into the body part, and a travelway at the base of the incline extending towards the rearward lower regions of said side walls; and said second slot means comprising, rearward in the plunger, a vertical fall cavity for the pin means; one of said slot means comprising a buttress wall against which the pin means can strike to arrest the plunger part when the plunger part moves into the body part above a threshold velocity and which the pin means can pass to permit the plunger part to complete its full movement into the body part when the plunger part moves into the body part below said threshold velocity; and a cover part covering both the slot means to confine the pin means in said slot means.

2. A door arrestor as claimed in claim 1 in which said buttress wall is in said second slot means.

3. A door arrestor as claimed in claim 1 in which said body part has lip means to engage said door frame to resist movement of said body part on said door frame when the plunger part is struck by a closing door.

4. A hinged door and door frame combination comprising, on the door frame, an arrestor for the door which is struck by the door prior to the door closing, said arrestor comprising a body part mounted on the door frame, the body part having a roof and having side walls defining first elongate slot means extending from the upper front to the lower rear of the side walls; a plunger part projecting from the front of the body part, movable in to the body part and defining second elongate slot means extending from the upper rear to the lower rear of the rearward part of the plunger part; spring means between the body part and the plunger part acting in a sense to return the plunger part to its position of projecting from the front of the body part; horizontally disposed headless pin means loosely carried in both said slot means; said first slot means defining a rest cavity for the pin means in the upper front of the side walls, defining a rearwardly extending downward incline for the pin means when it leaves the rest cavity and defining a travelway at the base of the incline to the lower rear of the side walls; and said second slot means having a vertical extent corresponding to the vertical extent of the first slot means and a horizontal extent greater than the diameter of the pin means; and a boss on said plunger extending into the second slot means on which the pin means can lodge.

5. The combination of claim 4 in which the door has a recessed pad attached thereto which is located so as to contact the plunger when the door strikes the arrestor.

6. A door and door frame combination as claimed in claim 4 in which the plunger part has adjuster means for adjusting the projection of the plunger part from the body part thereby to regulate at which point the door strikes the arrestor.

* * * * *